US006006474A

United States Patent [19]

Stocksmeier

[11] Patent Number: 6,006,474

[45] Date of Patent: Dec. 28, 1999

[54] AUDIO PEEPHOLE FOR DOORS

[76] Inventor: Eckard Stocksmeier, Engelbert-Kämpfer-Strasse 58, D-32657 Lemgo, Germany

[21] Appl. No.: 09/205,098

[22] Filed: Dec. 3, 1998

[30] Foreign Application Priority Data

Dec. 5, 1997 [DE] Germany ..... 297 21 493 U

[51] Int. Cl.[6] ..... E06B 7/28

[52] U.S. Cl. ..... 49/171

[58] Field of Search ..... 49/163, 169, 171, 49/38, 39; 109/21.5, 58.5

[56] References Cited

U.S. PATENT DOCUMENTS 775,798 11/1904 Chase ..... 49/39
1,340,673 5/1920 Roe ..... 49/171 X
4,644,687 2/1987 Liou ..... 49/171 X
5,671,564 9/1997 Lyle ..... 49/171

*Primary Examiner*—Jerry Redman
*Attorney, Agent, or Firm*—Browdy and Neimark

[57] ABSTRACT

The audio peephole for doors (T) comprises two flange bushings (2, 3), which are inserted into one another and held together by a two-piece screw-type optical spy-hole (1), with the flange bushings (2, 3) having in their flange (2*a,* 3*a*) a central reception hole (4) for the optical spy-hole (1) and at a distance around this central reception hole (4) a plurality of sound apertures (5) penetrating the flange (2*a,* 3*a*) and terminating in the hollow space (H) of the flange bushings (2, 3). These sound apertures (5) can be opened for sound transmission and closed against sound transmission by means of a manually rotatable apertured disk (6) provided behind the flange (2*a*) of the flange bushing (2) on the interior of the door.

4 Claims, 1 Drawing Sheet

AUDIO PEEPHOLE FOR DOORS

BACKGROUND OF THE INVENTION

TECHNICAL FIELD OF THE INVENTION

The present invention is aimed at the creation of a simple and cost-effective audio peephole, which consists of only a few components in a compact design and can be easily and securely mounted in a door and, in addition to the permanent view, also permits a sound transmission from the inside to the outside, and vice versa, and an interruption of this sound transmission.

SUMMARY AND OBJECT OF THE INVENTION

The audio peephole for doors according to the invention is constructed of only a few components in a simple and cost-effective manner and has a compact, small-volume design. This audio peephole can be mounted easily and securely in a door, and apart from offering a permanent view also permits a sound transmission from the inside to the outside and vice versa, as well as an interruption of this sound transmission.

According to its basic principle, the audio peephole comprises two flange bushings, which can be inserted into one another, each having in their flange a central reception hole for the optical spy-hole and sound apertures arranged around this central reception hole; and it furthermore comprises the two-piece optical spy-hole, which is provided with a screw thread; and as a closing and opening shield an apertured disk, which can be operated via a handle.

The two flange bushings are held together by the screwed-together optical spy-hole in such a way that the optical spy-hole is screwed together from the interior of the door, and the flange bushing that is located on the exterior of the door engages into the door by means of integral cams provided on the flange in a manner so that it cannot be rotated relative to the door, rendering impossible an unscrewing and removal of the audio peephole from the outside.

The audio peephole enables the resident inside the apartment to see callers on the outside, and at the same time provides for a sound transmission from the inside to the outside and vice versa through the sound apertures in the flange bushings. These sound apertures permit a practical speaking through the door, and the apertured disk, which matches the flange bushing on the interior of the door, permits an interruption of this sound transmission by covering the sound apertures in the flange bushing so that no sounds are possible from the inside out or vice versa.

The sound apertures in the flanges of the two flange bushings are located in dome or funnel shaped recesses, as a result of which the sound is bundled and centered as it is guided toward the sound apertures and through the audio peephole.

The audio peephole may additionally be secured by an exterior and an interior ring and screw means in the form of studs and tapped bushes connecting these two rings in such a way that these rings cover the flanges of the two flange bushings.

The exterior ring is designed in the form of a door shield.

The screw connection of the optical spy-hole and also of the two rings always takes place from the interior of the door, so that unscrewing and removal of the audio peephole from the outside is rendered impossible, a feature which is furthermore enhanced by the design of the exterior ring in the form of a door shield.

BRIEF DESCRIPTION OF THE DRAWINGS

An embodiment of the invention is described in more detail below, based on the drawing in which.

DETAILED DESCRIPTION OF THE PREFERRED EMBODIMENT(S) OF THE INVENTION

Figure 2:
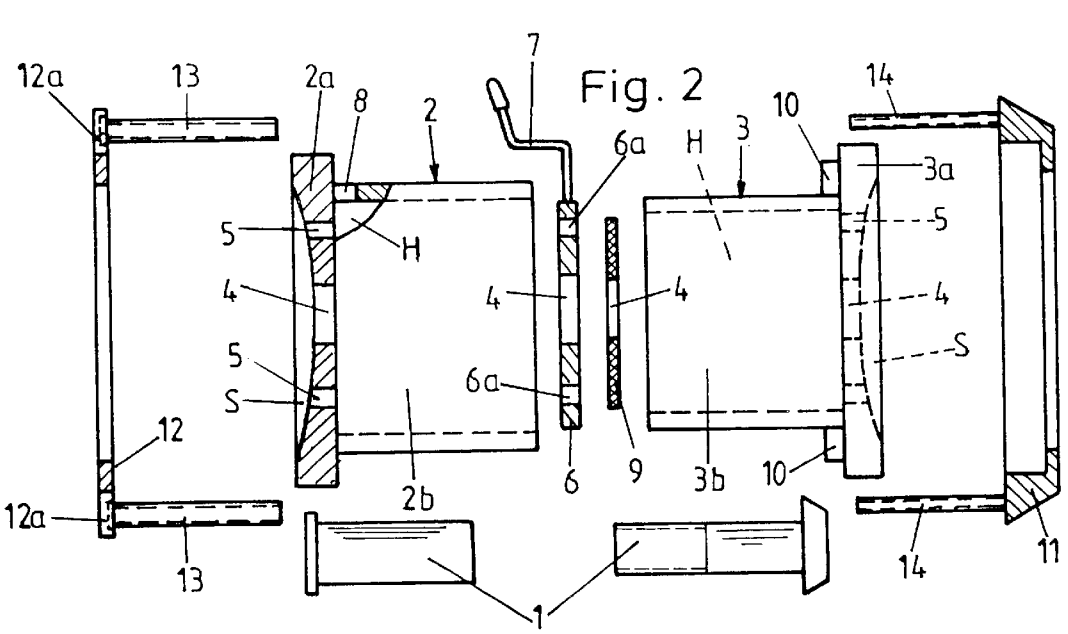
FIG. 2 shows a side view of the components of the audio peephole in an exploded illustration, partly cut open.
Figure 1:
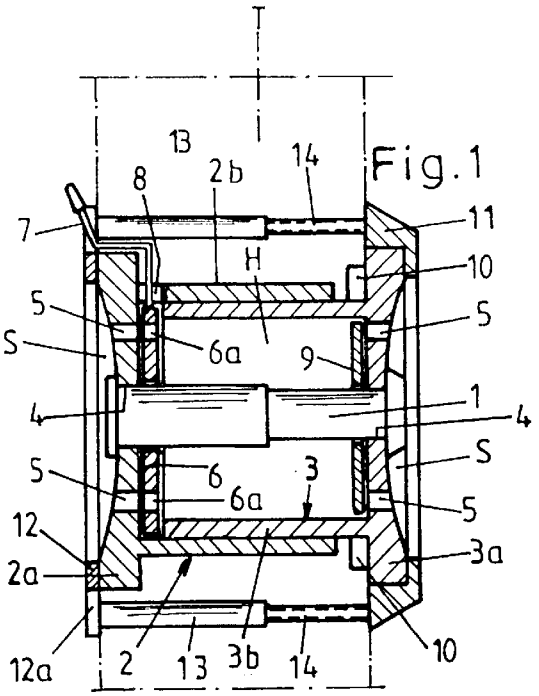
FIG. 1 shows a longitudinal section through an audio peephole for doors.
Figure 6:
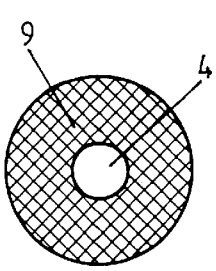
FIG. 6 shows a front view of a fly-screen disk.
Figure 5:
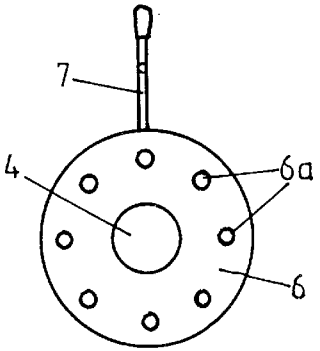
FIG. 5 shows a front view of an apertured disk with operating lever.
Figure 4:
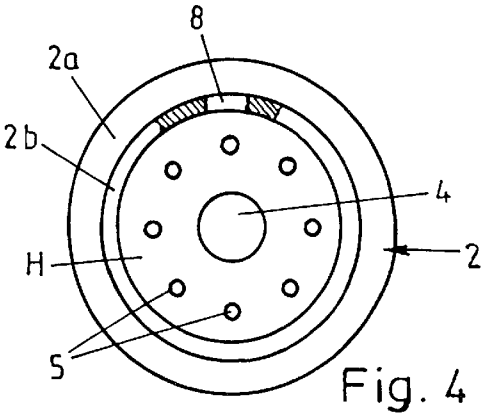
FIG. 4 shows a front view of a flange bushing.
Figure 3:
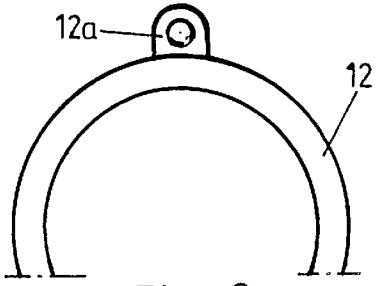
FIG. 3 shows a plan view of a portion of an interior ring.

The audio peephole (optical listening/speaking peephole) for doors (T) has two flange bushings (2, 3), which are inserted into one another and held together by a two-piece, screw-type optical spy-hole (1), and which have in their flange (2*a*, 3*a*) a central reception hole (4) for the optical spy-hole (1) and at a distance around this central reception hole (4) a plurality of sound apertures (5) penetrating the flange (2*a*, 3*a*) and terminating in the hollow space (H) formed by the two flange bushings (2, 3). This hollow space (H) is formed primarily by the interior bushing part (3*b*), and as a consequence all sound apertures (5) are also located within the cross section of hollow space (H).

Provided inside the flange bushing (2) on the interior of the door, behind the flange (2*a*), is a manually rotatable apertured disk (6), which unblocks the sound apertures (5) of this flange bushing (2) for the transmission of sound and closes it against the transmission of sound.

Around the reception hole (4) in each flange (2*a*, 3*a*), a series of sound apertures is arranged along a reference circle, with the sound apertures (5) extending parallel to the longitudinal direction of the flange bushings.

The outer front side of the flange (2*a*, 3*a*) of both flange bushings (2, 3) is designed in the form of a dome shaped or funnel shaped recess and the sound apertures are located in this recessed front side (S); the sound is bundled by the dome or funnel shape (S) and guided to the apertures (5) in a concentrated form and exits the apertures (5) with little loss.

Each of the two flange bushings (2, 3) consists of a cylindrical, circular bushing part (2*b*, 3*b*) and its integral flange (2*a*, 3*a*), which is formed by a circular disk, which is enlarged relative to the bushing part (2*b*, 3*b*).

The apertured disk (6) is provided with the apertures (6*a*) in a number corresponding to the apertures (5) in the flange (2*a*) of the flange bushing (2) on the interior of the door, and with an operating lever (7), which is rendered pivotable to a limited extent by means of a groove (8) provided in the bushing part (2*b*) and which extends, with a plurality of bends, past the flange (2*a*), protruding beyond the interior of the door (T) for manual operation.

Both flange bushings (2, 3) preferably have the same number of cut-out sound apertures (5).

The apertured disk (6) is held in a fixed position between the front end of the inserted bushing part (3*b*) and the flange (2*a*) in the axial direction of the flange. In the rotation position in which the apertured disk (6) opens the sound apertures (5), the apertures (6*a*) of the apertured disk (6) are congruent with the sound apertures (5) in the flange (2*a*), so that transmission channels are formed.

To close the sound apertures (5), the apertured disk (6) is rotated until its apertures (6*a*) are all located between adjacent sound apertures (5) and the apertured disk (6) thus blocks the sound apertures (5). The adjustment of the apertured disk (6) is determined by the lever (7) which is pivoted inside the groove (8) of the bushing part (2*b*) from one end of the groove to the other in the circumferential direction of the flange.

Inside the bushing part (3*b*) of the flange bushing (3) on the exterior of the door, a disk-shaped fly-screen (9)—a thin net disk—is arranged around the optical spy-hole (1), behind the sound apertures (5) of the flange (3*a*). The apertured disk (6) and the fly-screen (9) also have a central reception hole (4) for the optical spy-hole.

The inside of the flange (3*a*) of the flange bushing (3) on the exterior of the door, which is adjacent to the bushing part (3*b*), has at least one, preferably two opposite integral securing projections (10), for example in the form of cams, which engage into the door (T).

The basic design of the audio peephole comprises the two flange bushings (2, 3) that are inserted into one another at least nearly form-fitting; the perforated aperture (6), which can be rotated to a limited extent inside these flange bushings (2, 3); the fly-screen (9); and the optical spy-hole (1).

The two flange bushings (2, 3) are inserted from the inside and outside into a corresponding cut-out in the door (T) and inserted into one another with their bushing parts (2*b*, 3*b*) until their two respective flanges (2*a*, 3*a*) rest against the interior and exterior of the door, with the cams (10) engaging into the door (T). By inserting the two optical spy-hole parts from the inside and outside into the holes (4) and screwing the optical spy-hole (1) together, the two flange bushings (2, 3) are pushed against the door (T) and held together.

The cams (10) then prevent an unauthorized unscrewing of the audio peephole from the outside since it is not possible to rotate the exterior flange bushing (3).

The basic design of the audio peephole may be expanded with the components described below, namely with an exterior ring (11) designed in the form of a door shield that encompasses the outer circumference and front of the flange (3*a*) of the flange bushing (3) on the exterior of the door, and an interior ring (12) that encompasses the outer circumference of the flange (2*a*) on the interior of the door, with both rings held together by means of integral screw connections (13, 14) in the form of tapped bushes and studs.

The interior ring (12) has two integral brackets (12*a*) through which the tapped bushes (1, 3) with collar are inserted, and the exterior ring (11) is provided with studs (14) (threaded bolts); the studs (14) are attached to the inside of the exterior ring (11).

The screw means (13, 14) extend through the hole provided in the door (T) for the flange bushings (2, 3) or through separate holes.

The tapped bushes (13) are screwed onto the studs (14) from the inside, in a manner so that their heads come to rest before or inside the interior ring (12).

The two rings (11, 12) result in an additional secure fastening of the audio peephole in the door (T) in that they push against the flanges (2*a*, 3*a*) of the flange bushings (2, 3) and cover same on the inside and outside.

It is also possible to use a different type of ring assembly with screws, studs, bushings and nuts.

The flange bushings (2, 3), the apertured disk (6) and the exterior and interior ring (11, 12) with the screw means (13, 14) are made of plastics and/or metal.

What is claimed is:

1. An audio peephole adapted for use on an exterior and interior of door, comprising two flange bushings (2, 3), which are inserted into one another and held together by screw-type two-piece optical spy-hole (1), said flange bushings (2, 3) having in a flange (2*a*, 3*a*), a central reception hole (4) for the optical spy-hole (1) and at a distance around this central reception hole (4) a plurality of sound apertures (5) penetrating the flange (2*a*, 3*a*) and terminating in a hollow space (H) of the flange bushings (2,3), said sound apertures (5) being opened for sound transmission and closed against sound transmission by means of a manually rotatable apertured disk (6) located behind the flange (2*a*) of a flange bushing (2) on the interior of the door, wherein, the series of sound apertures is arranged around the central reception hole (4) in each said flange (2*a*, 3*a*) along a reference circle in a manner so that the sound apertures (5) extend parallel to the longitudinal direction of the flange bushing, wherein, the outer front side (S) of the flange (2*a*, 3*a*) of both flange bushings (2, 3) is designed in a form of a funnel shaped recess, wherein, each of the two flange bushings (2, 3) comprises a cylindrical circular bushing part (2*b*, 3*b*) and an integral flange (2*a*, 3*a*) formed by a circular disk, which is enlarged relative to the bushing part (2*b*, 3*b*), wherein, an apertured disk (6) is provided with a plurality of apertures (6*a*) that correspond to said plurality of sound apertures (5) in the flange (2*a*) of the flange bushing (2) on the interior of the door and is connected to an operating lever (7), which can be pivoted to a limited extent inside the bushing part (2*b*) by means of a groove (8) and extends, with multiple bends, past the flange (2*a*) beyond the interior of the door (T) for manual operation, wherein a disk-shaped fly-screen (9) is arranged around the optical spy-hole (1) inside the bushing part (3*b*) of the flange bushing (3) on the exterior of the door, behind the sound apertures (5) of the flange (3*a*), wherein at least one securing projection (10), such as a cam, which engages into the door (T) is provided, as an integral part, on an inside of the flange (3*a*) of the flange bushing (3) on the exterior of the door adjacent to the bushing part (3*b*).

2. An audio peephole according to claim 1, wherein an exterior ring (11) in a form of a door shield, which encompasses an outer circumference and front side of the flange (3*a*) of the flange bushing (3) on the exterior of the door, and an interior ring (11), which encompasses the outer circumference of the flange (2*a*) on the interior of the door, are provided with both rings held together by means of integral screw connections (13, 14) in a form of bushes and studs.

3. An audio peephole according to claim 2, wherein the flange bushings (2, 3), the apertured disk (6) and the exterior ring and the interior ring (11, 12) with the screw connections (13, 14) are made of plastic.

4. An audio peephole according to claim 2, wherein the flange bushings (2, 3), the apertured disk (6) and the exterior ring and the interior ring (11, 12) with the screw connections (13, 14) are made of metal.

* * * * *